United States Patent [19]

Ciumaga

[11] Patent Number: 4,813,579

[45] Date of Patent: Mar. 21, 1989

[54] PAINT CAN POURING SPOUT

[76] Inventor: Massimo Ciumaga, 1639 Bissonnett, Houston, Tex. 77005

[21] Appl. No.: 39,703

[22] Filed: Apr. 20, 1987

[51] Int. Cl.[4] ..... B65D 25/40

[52] U.S. Cl. ..... 222/570; 220/85 SP; 220/90

[58] Field of Search ..... 222/570, 569, 567; 220/85 SP, 90

[56] References Cited

U.S. PATENT DOCUMENTS

| | | | |
|---|---|---|---|
| 1,952,288 | 3/1934 | Saxon | 222/569 |
| 1,967,191 | 7/1934 | John | 229/3.1 |
| 2,564,979 | 8/1951 | Jorgensen | 222/570 X |
| 2,707,574 | 5/1955 | Klebenow | 222/570 X |
| 2,771,208 | 11/1956 | Chovanes | 220/90 X |
| 2,904,208 | 9/1959 | Woolfolk | 220/90 X |
| 3,102,667 | 9/1963 | Ullevig | 222/570 X |
| 3,252,635 | 5/1966 | Rosenhan | 222/570 X |
| 3,695,488 | 10/1972 | Olsson | 222/570 |
| 3,853,249 | 12/1974 | Weir, Jr. et al. | 222/570 |
| 3,994,424 | 11/1976 | Koeller | 222/570 |
| 4,316,560 | 2/1982 | Carter | 222/567 |
| 4,353,489 | 10/1982 | Arnold et al. | 222/570 |
| 4,369,890 | 1/1983 | Bennett | 222/570 X |

FOREIGN PATENT DOCUMENTS

| | | | |
|---|---|---|---|
| 278429 | 10/1927 | United Kingdom | 220/90 |

*Primary Examiner*—H. Grant Skaggs
*Assistant Examiner*—David H. Bollinger
*Attorney, Agent, or Firm*—Pravel, Gambrell, Hewitt, Kimball & Krieger

[57] ABSTRACT

This invention is a disposable paint can pouring spout which snaps easily onto a typical paint can rim and attaches securely to the inner bead of the paint can opening. A locking member is shaped to fit securely on the can opening and its ends lock together for greater rigidity. To this locking member is attached a pouring member which can be configured to extend straight out of the can opening or which can extend at any angle.

8 Claims, 1 Drawing Sheet

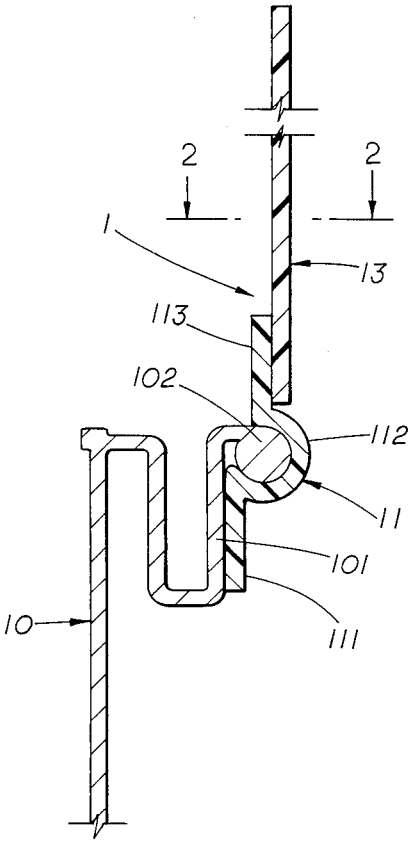
FIG.1
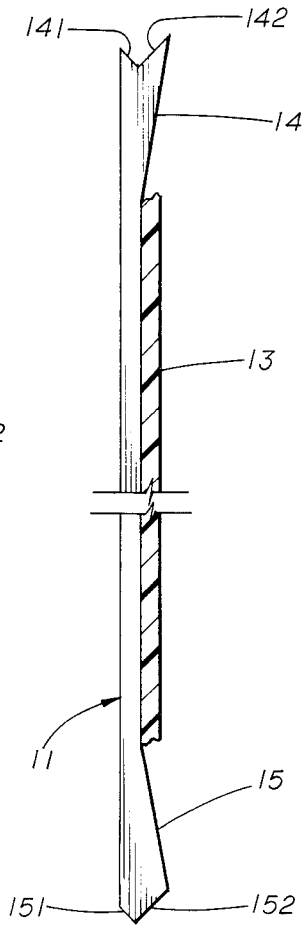
FIG.2
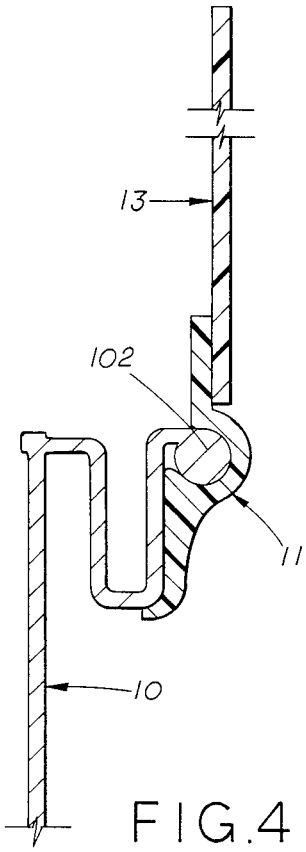
FIG.4
FIG.3
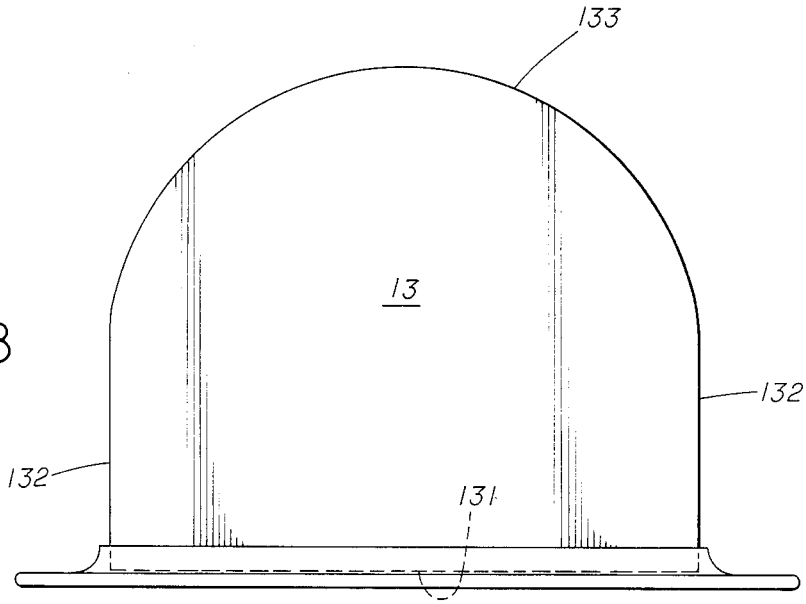

PAINT CAN POURING SPOUT

BACKGROUND OF THE INVENTION

1. Field of the Invention

The invention is a pouring spout made so that it can be attached to the rim of a paint can to facilitate pouring the paint without spillage and without leaving a residue of paint on the top of the can. The spout can be removed when the lid is replaced on the can and then re-attached when more paint is to be poured from the can. The spout is flexible so that it will conform to variations in can opening diameter.

2. Description of the Prior Art

The opening of the typical present day paint can is designed to provide a configuration to which a removable lid can be securely attached. This is necessitated by the requirement that there be no spillage or contamination of the contents during shipping or during handling by the end user. It is also necessary to provide for repeated opening and closing of the can without damage. These objects were achieved by providing a deep channel around the edge of the can opening, into which a ridge around the edge of the lid can fit, and by providing a reinforcing bead around the inner edge of the can opening. This combination provides a secure fit between can and lid, while preventing deterioration of the edge of the opening during repeated use. There are, however, two undesirable side effects. First, the bead, and to some extent the channel, create turbulent flow of the paint when it is poured from the can. This turbulence results in flow of some paint down the outside of the can during pouring, requiring clean up or causing an undesirable mess. Second, after each pouring, some paint is trapped in the channel where it dries, causing the lid to stick to the can.

The present invention provides a removable pouring spout, designed to alleviate these problems. The pouring spout, which has a lower flange for stiffening, can be snapped onto the inner bead forming a rigid pouring spout of the desired configuration. This provide flow relatively free of turbulence because of the extension of the pouring cone from a point along the circumference of the inner bead to a lip extended from the can opening. It also prevents paint from ever flowing into the channel around the can opening, so that the lid will not become stuck in dried paint as before.

Other devices have been made which attempt to alleviate these problems, but the most similar devices suffer from various disadvantages as listed here. U.S. Pat. No. 4,369,890 utilizes small tabs to lock onto the inner bead of the can, providing very little stability and no sealing qualities. U.S. Pat. No. 4,299,340 relies on a gripping action on the inner and outer beads of the can, requiring that the attachment be sized exactly to fit the particular brand of can. It also fails to engage the inner bead to the same extent as does the present invention, so its ability to seal against paint leakage into the channel would not be as great.

U.S. Pat. No. 4,353,489 also relies on a reduced engagement of the inner bead, promoting leakage, and it must be sized exactly to fit the particular can. U.S. Pat. No. 3,853,249 relies on only two points of engagement of the inner bead and the bottom of the channel in the can. U.S. Pat. No. 1,867,060 is designed to fit older paint cans, and if inserted in a present day can would not likely have the necessary rigidity. U.S. Pat. No. 1,952,288 lacks any feature, such as the lower flange of the present invention, to provide rigidity, and it has no means for maintaining the ends of the spout in contact with the inner bead of the can opening, such as the interlocking ends of the present invention.

SUMMARY OF THE INVENTION

The present invention provides a pouring spout which will prevent paint from flowing into the channel in the top of the paint can or onto the outside of the can. It is essentially a flexible sheet with a flexible tubular channel along one edge. The preferred embodiment will adapt to small variations in can opening sizes, it can easily be manufactured in various sizes and pouring configurations, it is cheap enough to be disposable, and it is durable enough to be used several times. The spout can be made from various flexible plastics or from a combination of plastic and cardboard. It can slope at various angles from vertical to almost horizontal to work best with the viscosity of the paint involved, or as desired for the type of pouring stream necessary.

DESCRIPTION OF THE DRAWINGS

The present invention will now be described with reference to the drawings which are briefly described below:

FIG. 1 is a sectional view of the preferred embodiment mounted on a paint can.

FIG. 2 is a plan view of the locking member.

FIG. 3 is an elevation of the pouring spout laid flat.

FIG. 4 is an alternative low turbulence embodiment of the locking member.

DESCRIPTION OF THE INVENTION

Referring to FIG. 1, the spout 1 has two components, a pouring member 13, attached to a locking member 11. Locking member 11 is a flexible plastic open-sided tubular member which can be made, for example, by an extrusion process. Viewed in cross-section, locking member 11 exhibits a lower flange 111 positioned to press against inner lip 101 of can 10 around its entire circumference. Additionally, locking member 11 exhibits a central open-sided tube 112 with inner diameter sized to fit snugly over inner bead 102 of can 10 and with an open side running lengthwise on tube 112 sized to snap tightly over inner bead 102. Extending from the side of tube 112 opposite lower flange 111 is upper flange 113 positioned to extend outward from the can opening and receive the pouring member 13. Upper flange 113 is shown in the preferred embodiment to extend vertically from the can opening, forming a cylinder concentric with the cylinder formed by lower flange 111, but alternately, upper flange 113 can extend at various angles to form either diverging or converging conical surfaces, thereby forming different configurations of pouring member 13.

Referring to FIG. 2, the preferred embodiment of locking member 11 has affixed to its ends interlocking ends 14 and 15. In plan view, interlocking end 14 has a notch shaped to receive a wedge on interlocking end 15, so that when locking member 11 is snapped onto inner bead 102, interlocking ends 14 and 15 will engage so as to maintain alignment of the respective ends of locking member 11. This engagement resists any tendency of either end of locking member 11 to be pulled from inner bead 102 by forces exerted on pouring member 13 during pouring. The notch in interlocking end 14 and the wedge on interlocking end 15 are formed by surfaces 141, 142, 151 and 152, all of which lie in planes parallel to the axis of can 10 so that interlocking ends 14 and 15 can be engaged simultaneously with installation of locking member 11 on inner bead 102. The length of locking member 11 can be varied to fit various sizes of cans. Exact length is not crucial in the preferred embodiment since the notch and wedge on interlocking ends 14 and 15 can be sized or shaped to allow for some variation in can diameter while still locking securely.

As shown in FIG. 3, pouring member 13 is a flexible flat sheet which in the preferred embodiment has a straight edge 131 which is attached by gluing, bonding or suitable mechanical fasteners to upper flange 113 of locking member 11. This embodiment also has two straight edges 132 at right angles to edge 131 and arcuate edge 133 opposite straight edge 131. Alternative embodiments of pouring member 13 can have edges cut as required to match different angles of upper flange 113 and as required to achieve different configurations of pouring spouts.

The invention is not limited to one in which the locking member and the pouring member are formed separately and then joined. The spout could be formed in a single manufacturing process producing the locking member and the pouring member as an integral unit.

I claim:

1. A paint can pouring spout, comprising:

a flexible elongate locking member having two ends, shaped to fit securely on the inner bead of the opening of a paint can;

a pouring member, connected along one side thereof to the flexible locking member, shaped to form a spout when the flexible locking member is fitted into a paint can; and means for locking the ends of the locking member together when installed on a paint can, wherein the means for locking the ends of the locking member comprise a wedge on one of the ends and a matching notch on the other end, and wherein the wedge and the notch are formed by flat intersecting surfaces parallel to a longitudinal axis of the paint can when installed thereon, to facilitate snapping the wedge and the notch together when attaching the spout to the can.

2. A paint can pouring spout as recited in claim 1, wherein:

the locking member is a strip of flexible material; and the locking member includes a central tube open on one side which can be spread to fit over the inner bead of a paint can opening and which will then snap back to its original shape to grip the bead.

3. A paint can pouring spout as recited in claim 2, wherein:

the locking member has a flange which attaches to the tube contiguous to the open side; and the flange forms a cylinder concentric with a longitudinal axis of the paint can when installed thereon, lying along the inner lip of the can opening under the inner bead of the opening.

4. A paint can pouring spout as recited in claim 3, wherein the tube has a circular cross section the inner diameter of which substantially matches the diameter of the inner bead on a paint can opening.

5. A paint can pouring spout as recited in claim 1, wherein:

the pouring member is a flexible sheet; and the sheet extends substantially around the entire circumference of the paint can opening when installed thereon.

6. A paint can pouring spout as recited in claim 5, wherein:

the sheet extends out from the can opening perpendicular to the plane of the top of the paint can; and the edge of the sheet distal from the paint can opening has an arcuate contour to shape the stream of the paint being poured.

7. A paint can pouring spout as recited in claim 5, wherein the sheet is formed to extend from the paint can opening at an angle from the axis of the can.

8. A paint can pouring spout, comprising:

a flexible locking member having a tube open on one side;

a cylindrical contour on the inner surface of the tube, with a diameter substantially equal to the diameter of the inner bead on a paint can opening;

a first flange extending from the tube contiguous to the open side, shaped to lie along the inner lip of the can opening under the inner bead of the opening;

interlockiing ends on the locking member wherein one of the ends has a wedge thereon and the other end has a notch thereon, shaped to snap together when the spout is installed on the can, wherein the wedge and the notch are formed by flat intersecting surfaces parallel to a longitudinal axis of the paint can when installed thereon, to facilitate snapping the wedge and the notch together when attaching the spout to the can;

a second flange extending from the tube on the opposite edge of the open side from the first flange;

a pouring member in the form of a flexible sheet attached to the second flange, extending substantially around the entire circumference of the opening of the paint can, and extending outward from the plane of the paint can opening in a cylindrical shape concentric with a longitudinal axis of the paint can; and an arcuate contour on the edge of the pouring member distal from the edge attached to the second flange, to shape the stream of paint being poured.

* * * * *